US009844707B2

(12) United States Patent
Davis

(10) Patent No.: US 9,844,707 B2
(45) Date of Patent: Dec. 19, 2017

(54) LIE ADJUSTABLE HIGH MOMENT OF INERTIA PUTTER

(71) Applicant: Veritas Golf, LLC, Flagler Beach, FL (US)

(72) Inventor: Steven R. Davis, Flagler Beach, FL (US)

(73) Assignee: VERITAS GOLF LLC, Flagler Beach, FL (US)

( * ) Notice: Subject to any disclaimer, the term of this patent is extended or adjusted under 35 U.S.C. 154(b) by 0 days.

(21) Appl. No.: 15/278,176

(22) Filed: Sep. 28, 2016

(65) Prior Publication Data

US 2017/0014689 A1 Jan. 19, 2017

Related U.S. Application Data

(63) Continuation-in-part of application No. 14/600,034, filed on Jan. 20, 2015, now abandoned, which is a continuation-in-part of application No. PCT/US2014/037107, filed on May 7, 2014.

(60) Provisional application No. 61/823,860, filed on May 15, 2013.

(51) Int. Cl.

| | |
|---|---|
| ***A63B 53/02*** | (2015.01) |
| ***A63B 53/04*** | (2015.01) |
| ***A63B 53/00*** | (2015.01) |

(52) U.S. Cl.

CPC ..... *A63B 53/02* (2013.01); *A63B 53/007* (2013.01); *A63B 53/0487* (2013.01); *A63B 2053/025* (2013.01); *A63B 2053/0408* (2013.01); *A63B 2053/0491* (2013.01)

(58) Field of Classification Search

CPC ..... A63B 53/02; A63B 53/0487; A63B 2053/025; A63B 2053/0491; A63B 2053/0408; A63B 53/007

See application file for complete search history.

(56) References Cited

U.S. PATENT DOCUMENTS

| | | | | | |
|---|---|---|---|---|---|
| 1,643,250 | A | * | 9/1927 | Longsworth | A63B 53/065 473/248 |
| 3,096,982 | A | * | 7/1963 | Bassin | A63B 53/06 473/248 |
| 3,214,170 | A | * | 10/1965 | Warnock | A63B 53/007 273/126 A |
| 4,735,414 | A | * | 4/1988 | Williams | A63B 53/065 473/248 |
| 4,881,737 | A | * | 11/1989 | Mullins | A63B 53/065 403/84 |
| 5,244,205 | A | * | 9/1993 | Melanson | A63B 53/065 473/248 |

(Continued)

*Primary Examiner* — Stephan Blau
(74) *Attorney, Agent, or Firm* — Sven W. Hanson

(57) ABSTRACT

A high moment of inertia is enabled in a novel golf putter head in which also infinite adjustment of the lie angle and adjustment of total weight over a very wide range are enabled. The putter can be configured for either right-handed or left-handed players. The putter head has a cylindrical recess partially open through the top of the head and fully open to the rear of the head allowing the insertion of a cylindrical shaft receiver disc. The shaft can be of any allowed length and the lie angle can be from 26 degrees to 10 degrees from vertical. The mass properties of the putter head may be changed and adjusted by addition or removal of weights at the extreme toe and heel ends of the putter head.

6 Claims, 18 Drawing Sheets

(56) References Cited

U.S. PATENT DOCUMENTS 5,415,399 A * 5/1995 Kettelson ..... A63B 53/02 473/239
5,429,356 A * 7/1995 Dingle ..... A63B 53/02 473/251
5,628,697 A * 5/1997 Gamble ..... A63B 21/0602 473/326
5,716,287 A * 2/1998 Levocz ..... A63B 53/007 473/248
5,863,257 A * 1/1999 Busnardo ..... A63B 53/02 473/246
5,888,148 A * 3/1999 Allen ..... A63B 53/04 473/290
5,890,973 A * 4/1999 Gamble ..... A63B 21/0602 473/326
5,921,871 A * 7/1999 Fisher ..... A63B 53/04 473/329
5,924,938 A * 7/1999 Hines ..... A63B 53/02 473/307
6,142,884 A * 11/2000 Yim ..... A63B 53/02 473/248
6,203,444 B1 * 3/2001 McRae ..... A63B 53/0487 473/244
6,435,976 B1 * 8/2002 Galliers ..... A63B 53/02 473/244
6,527,649 B1 * 3/2003 Neher ..... A63B 53/02 473/248
2006/0264264 A1 * 11/2006 Sandino ..... A63B 53/007 473/248
2009/0170628 A1 * 7/2009 Yoon ..... A63B 53/0487 473/333
2014/0024473 A1 * 1/2014 Reid ..... A63B 53/02 473/313
2014/0378243 A1 * 12/2014 Sanyal ..... A63B 53/065 473/313

* cited by examiner u u

Figure 16
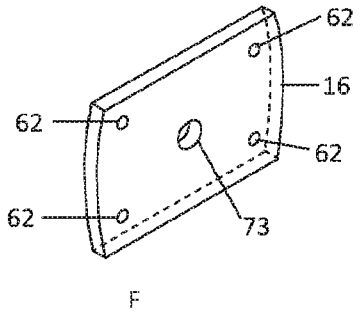
Figure 20
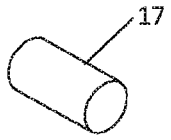
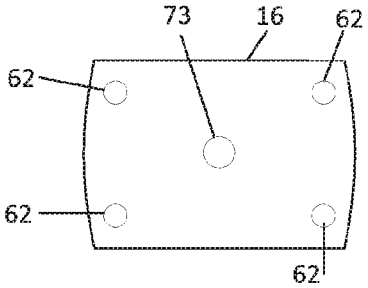
Figure 17
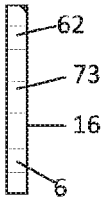
Figure 18
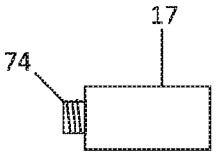
Figure 21
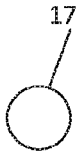
Figure 22
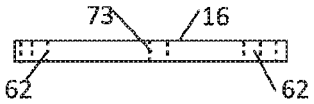
Figure 19

Figure

Figure 33A
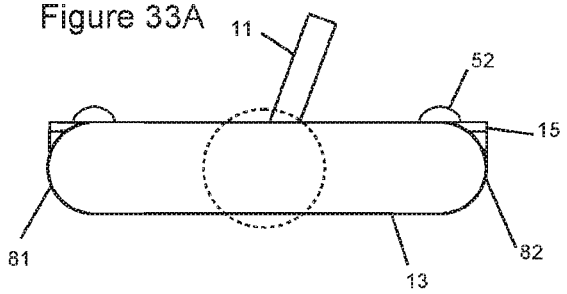
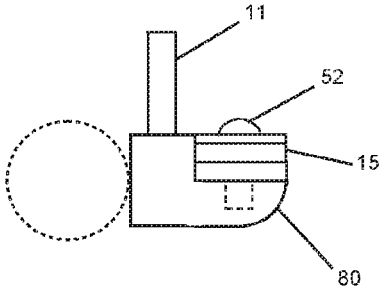
Figure 33B
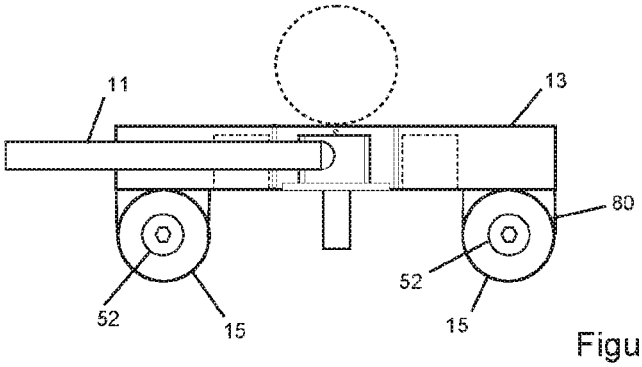
Figure 33C
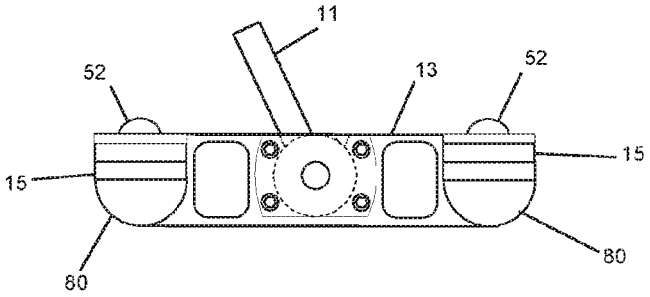
Figure 33D

LIE ADJUSTABLE HIGH MOMENT OF INERTIA PUTTER

CROSS-REFERENCE TO RELATED APPLICATIONS

This is a nonprovisional application is a continuation-in-part of the U.S. application Ser. No. 14/600,034 filed Jan. 20, 2015 that claims benefit of the filing of the provisional application filed on May 15, 2013 and having Application No. 61/823,860 and further claims benefit from international application PCT/US14/37107 filed on May 7, 2014.

BACKGROUND OF THE INVENTION

This invention relates to a putter-type golf club head with increased geometric size, increased moment of inertia, increased sole area, lie angle adjustability and decreased loft. Herein use of the word "putter" is intended to refer particularly to head of the putter.

Generally, increasing geometric size (linear dimensions) increases the moment of inertia for a putter head of a given mass. Herein, references to "moment of inertia" (MOI) relate to mass properties. Increasing moment of inertia increases the stability of the putter at impact and increased stability is desirable in a putter. A force is exerted on both a golf club and a golf ball when the club hits the ball. If the hit is slightly off-center (e.g., the center of mass of the golf club head is not directly behind the point on the golf club face where the club strikes the ball), then the forces will cause the golf club to twist slightly. The twisting of the golf club leads to the ball not traveling in the direction intended by the player or not rolling smoothly. Additionally, less energy is imparted to the golf ball when the putter twists. This commonly causes off-center hits to fall short of their intended target. Increasing the moment of inertia of the putter head decreases the tendency for the putter head to twist when hitting the ball.

The "loft" of a putter is generally understood to be the deviation of the plane of contact on a putter face from a vertical plane (the putter shaft being in the vertical plane). The standard loft on putters has decreased dramatically over time as golf greens have become better groomed and much faster than in previous times. Putters' lofts in earlier times have been as high as 7 degrees. A loft of about three or four degrees is standard today. Loft on putter faces causes the golf ball to leave the putter face with an upward trajectory and with backspin. This backspin causes the ball to skid and bounce before it later begins to roll smoothly. Reducing loft will reduce backspin, skidding and bouncing.

The standard lie angle of putters today is about 20 degrees from vertical. The "lie angle" here follows the common understanding of the term: the angle of the shaft from the vertical (in a plane perpendicular to the intended direction of travel of the ball in play) when the putter head is placed in its intended attitude on the ground. The sole (bottom face) of most putters is curved raising both the toe and heal of the putter off of the ground when the putter is soled at its center. Testing has confirmed that most golfers are using a putter with too little lie angle causing the toe of the putter to be further raised when the ball is addressed. Golf professionals seem to prefer slightly more upright putters than the general golfing public and golf club manufacturers have designed their putters with professional golfers. Most golf putter manufacturers have been unwilling to provide custom lie angles for their putter offerings; and pro shops and retailers have been similarly unwilling to stock all of the putters of every single model in multiple lie angles. The result is that most golfers are playing with a putter that is slightly too upright and the consequence of this poorly fitted putter is that the toe is most commonly slightly raised off the ground and the heal of the putter is soled on the ground. Herein the use of the word "sole" as a verb means to place the putter on or adjacent a playing surface in an attitude to strike a ball as intended.

With the putter toe in the air the loft of most putter faces will cause the ball to start to left of the actual aim line of the putter (for right-handed golfers). Because of this most golfers have subliminally learned to aim slightly to the right of their intended target and then the loft of the toe high putter pulls the putt back onto the intended line. The loft on a toe high putter also induces unwanted spin on the ball. Decreasing the loft of a putter decreases the problems associated with a toe high-lofted putter. Eliminating all loft on the putter eliminates the problem entirely.

The curved sole design of most putters makes them very difficult to sole on the ground accurately and consistently. A flat sole of significant area will allow the golfer to more consistently align the putter.

In light of the above, there is a need for a putter with decreased loft, higher moment of inertia and adjustable lie angle.

SUMMARY OF THE INVENTION

The present invention provides a golf putter wherein the putter lie angle is infinitely variably adjustable over a range, the putter's area of contact with the ground is maximized, and the moment of inertia is increased from the conventional and adjustable.

The inventive putter includes a mechanism for adjusting the angle of the handle relative to the putter head in order to allow for variation of the lie angle of the putter in use. At the same time, the mass moment of inertia of the putter head is adjustable by adding or removing discrete weights to the putter head while maintaining inertia balance. Placement of the weights, at the extremes of the toe and heel ends of the putter head, provides a maximum of effect on inertia.

According to a preferred embodiment of the invention there is provided a putter head for a golf putter, which includes a head, a shaft receiver, a shaft and removable weights. A shaft receiver disc is positioned within the disc cavity in the putter head. The disc can rotate together with a shaft in place and be fixed at an infinite number of incremental positions by tightening screws attaching the disc compression cover to the back of the putter head. The disc can be further secured by tightening the set screws bearing against the disc in the bottom of the putter head. The range of rotation can be restricted to positions allowed (by regulation or any other criteria) by the insertion of a rotation stop pin inserted in the disc.

Alternatively, in one configuration of the preferred embodiment, the shaft receiver disc and shaft can be removed from the disc cavity in the putter head and reversed in orientation and reinserted in the disc cavity in the reversed orientation to provide a left-handed putter.

In the preferred embodiment the putter head is further comprised of weights attached to the toe and heal of the putter head. The weight and moment of inertia of the putter head can be adjusted by adding or removing weights or by changing the size and weight of weight attachments. The additional weight may be attached to the rear of base weights. In the preferred embodiment, putter head has a mass in the range of 300 grams to 650 grams. Preferably, the putter is made of a lightweight metal such as aluminum or similar metal and the weights are made of the same lightweight metal or alternatively from a heavier metal.

Alternatively, the putter may be formed of any of a number of plastic materials or composites or other lightweight materials.

A number of advantages of the inventive lie-adjustable high MOI putter include: affording a higher moment of inertia for its weight and a higher moment of inertia compared to other putters of any weight, providing for low loft angle and a very large flat sole area. The current putter can be adjusted to the lie angle that best fits any individual amateur or professional golfer. The current putter can be changed from right handed to left handed. Other benefits and novel aspects of the inventive design will be clear from the following description of specific embodiments and from the accompanying drawing figures.

BRIEF DESCRIPTION OF THE DRAWINGS

FIGS. 16 to 22 illustrate various components of the putter head of FIG. 1.

FIGS. 33A to 33D are various views of the putter head of FIG. 31.

DETAILED DESCRIPTION OF THE INVENTION

Figure 1:
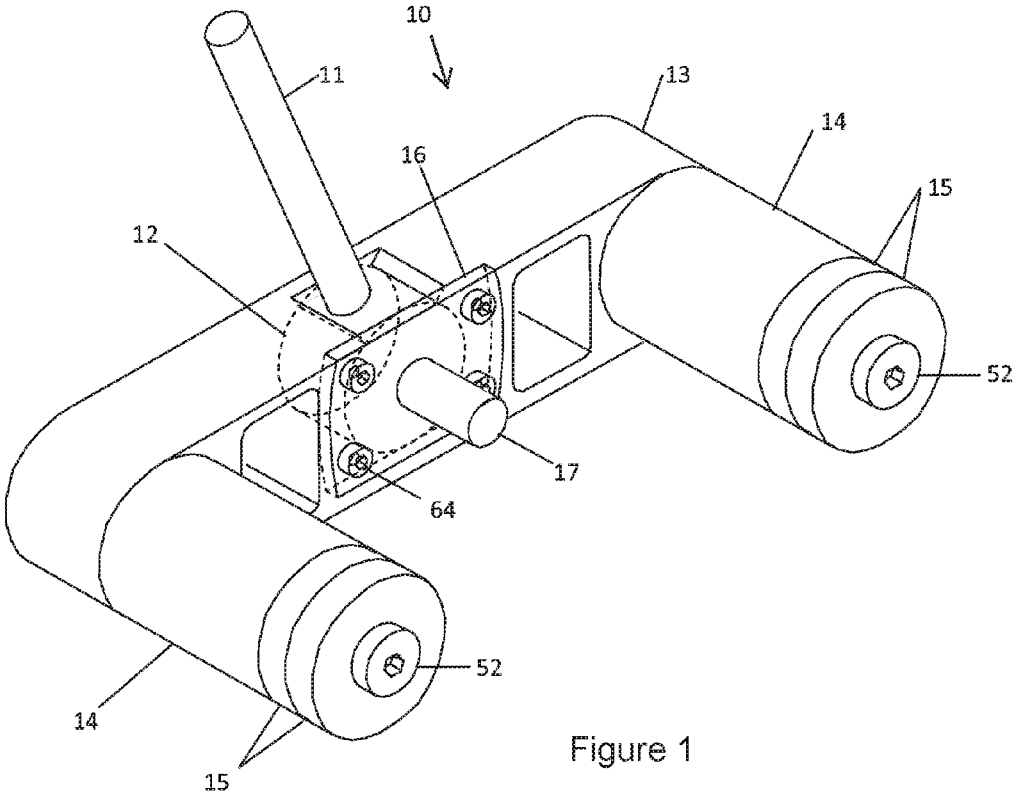
FIG. 1 is an isometric view of an assembled putter and putter head according to the invention.
Figure 2:
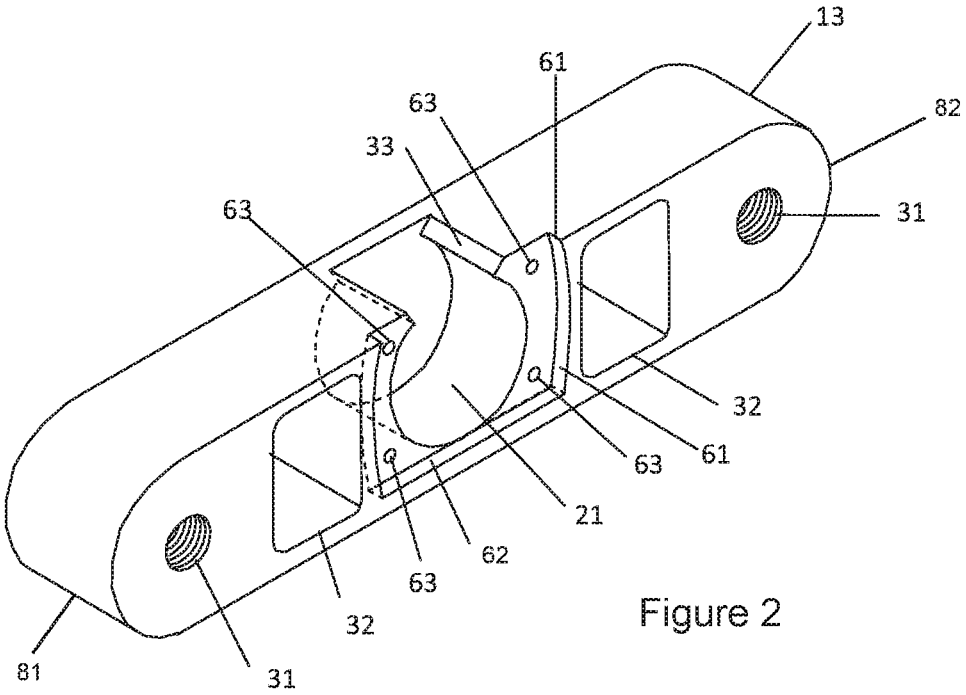
FIGS. 2 to 9 provide different views of the entire head portion, and detail sections, of the putter illustrated in FIG. 1.
Figure 3:
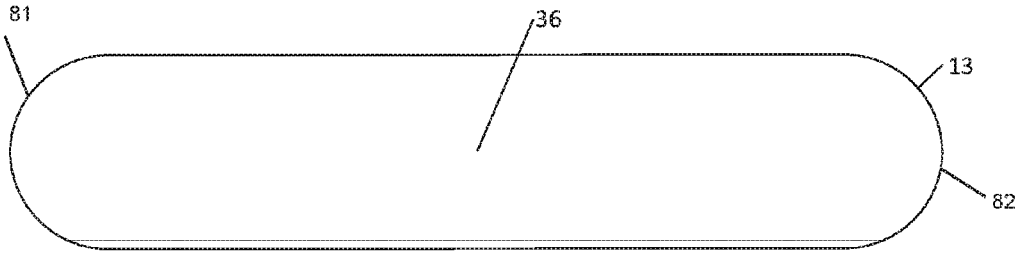
Figure 4:
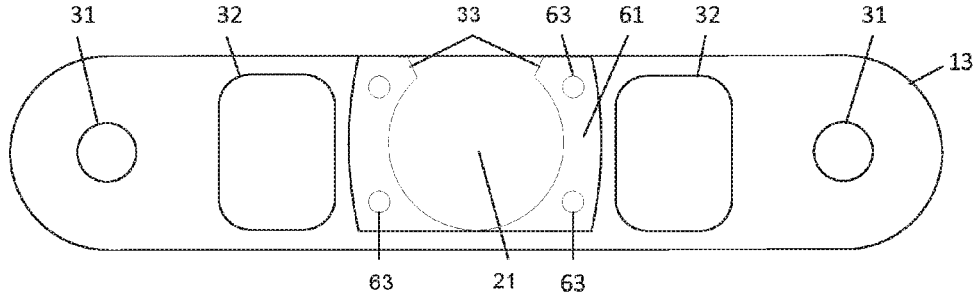
Figure 5:
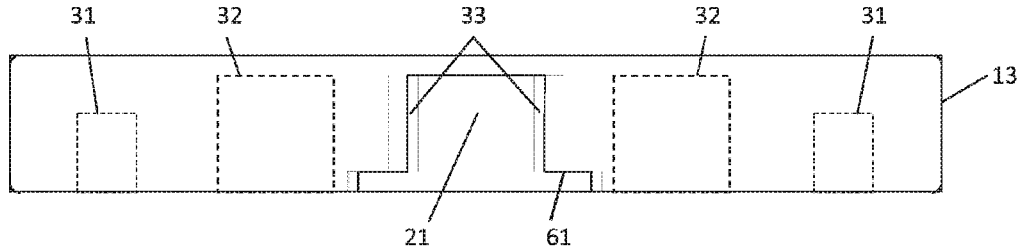
Figure 6:
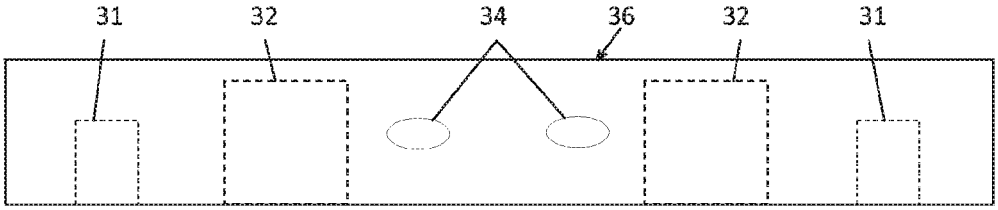
Figure 7:
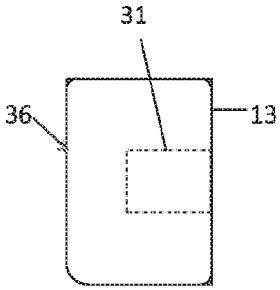
Figure 8:
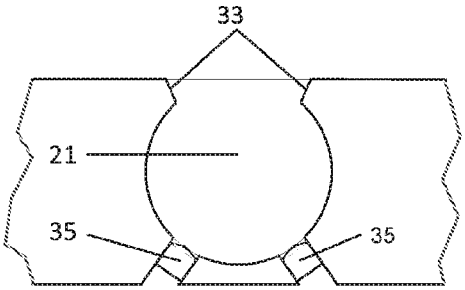
Figure 9:
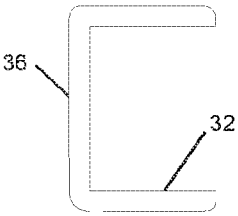

The following description relates to the embodiment illustrated in FIGS. 1 to 29. The following reference numeral list corresponds to the elements in the below description and the references provided in the accompanying drawing figures.

| List of Reference Numerals | |
|---|---|
| 10 | putter head |
| 11 | shaft |
| 12 | shaft receiver disc |
| 13 | putter head blade |
| 14 | base weight cylinder |
| 15 | additional weight cylinder |
| 16 | disc compression cover |
| 17 | alignment pin |
| 18 | grip |
| 20 | shaft disc assembly |
| 21 | disc cavity |
| 22 | shaft bore hole |
| 23 | rotation stop bore hole |
| 24 | rotation stop pin |
| 31 | cylinder attachment stud hole |
| 32 | weight reduction hole |
| 33 | rotation stop seat |
| 34 | set screw holes |
| 35 | set screw |
| 36 | putter face |
| 41 | weight cylinder hole |
| 42 | weight cylinder attachment stud |
| 51 | non-threaded weight cylinder hole |
| 52 | weight cylinder attachment screw |
| 61 | disc compression cover seat |
| 62 | disc compression cover screw hole |
| 63 | disc compression cover screw hole |
| 64 | disc compression cover attachment screw |
| 71 | alignment pin stud |
| 73 | alignment pin hole |
| 74 | alignment pin stud |
| 80 | weight support arm |
| 81 | blade toe end |
| 82 | blade heel end |
| 90 | first alignment indicia |
| 91 | second alignment indicia |
| 112 | alternative disc |
| 114 | set screws |
| 115 | control surface |
| 120 | cover seat surface |
| 122 | disk outer face |

The first embodiment of the putter head is illustrated as FIG. 1 having a shaft 11, a shaft receiver disc 12, a putter head blade 13, two base weight cylinders 14, two or more additional weight cylinders 15, two weight attachment screws 52, a disc compression cover 16, four disc compression cover attachment screws 64, an alignment pin 17, and a grip 18 (FIG. 10) for holding the putter by a user.

The shaft 11 is comprised of a hollow tube and a grip 18. A hollow tube potion of shaft 11 in a preferred embodiment is made of steel tubing, but may be made of graphite or other composite material. The shaft 11 may be of generally conventional design and construction except as detailed here.

The shaft receiver disc 12, putter head blade 13, disc compression cover 16, base weight cylinders 14, the additional weight cylinders 15 and the alignment pin 17 are preferably made of aluminum, but may be made of another metal. Alternatively, these elements may be formed of plastic or composite or other lightweight material having appropriate properties.

The grip 18 in a preferred embodiment is a standard golf putter grip, but may have any golf putter grip configuration and construction, particularly those sanctioned by governing bodies such as the USGA (United States Golf Association).

The putter face 36 is preferably planar, but may bulge forward (outward) in a convex curve. The putter face 36 forms the operative leading contact face of the putter head, whereby a golf ball is struck when a user performs a putting stroke. The putter face 36 is most preferably vertical with no loft, and preferably have a loft in the range of zero to two degrees. However, the other benefits of the inventive putter will be appreciated with greater loft angles.

Figure 14:
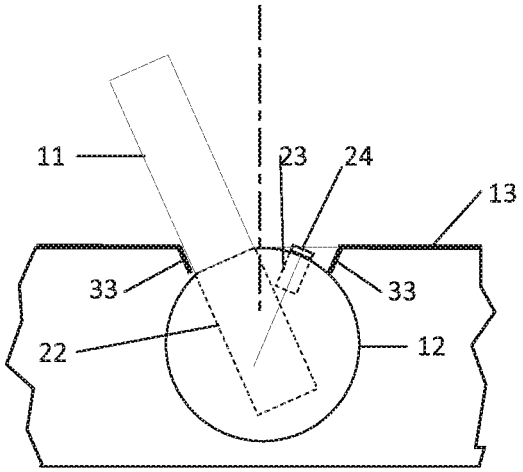
FIGS. 14 and 15 illustrate, in side view, alternative angular orientations of the putter handle in the putter head that are enabled by the configuration of the inventive putter of FIG. 1.
Figure 15:
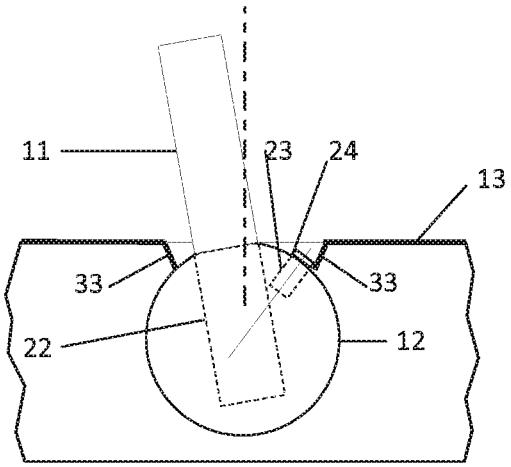
Figure 23:
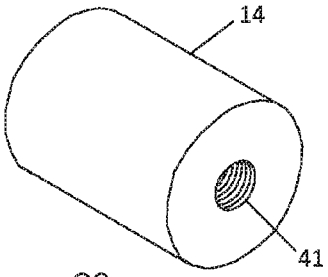
FIGS. 23 to 29 depict various weight components and their connecting elements of the putter head of FIG. 1.
Figure 26:
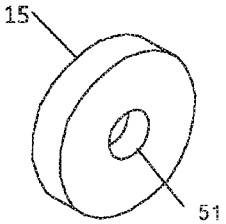
Figure 24:
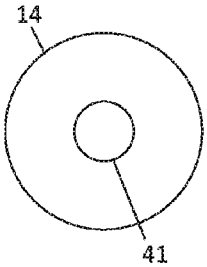
Figure 25:
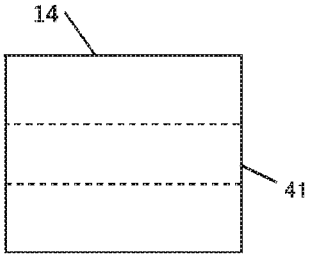
Figure 27:
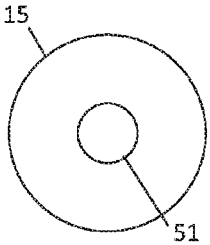
Figure 28:
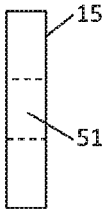
Figure 29:
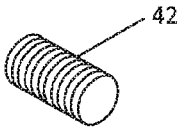

The putter head blade 13, disk cavity 21 and shaft receiver disc 12 should be configured to provide for a lie angle of the putter of any angle in the range of ten degrees to 26 degrees from vertical. These two angle orientations are shown in FIGS. 14 and 15. The angles are not expressly specified in the figures but may be discerned from the angular orientation of the shaft 11 relative to the head blade 13.

The shaft disc assembly 20 in a preferred embodiment is configured to enable it to be removed from the disc cavity 21, reversed in orientation (rotated about the shaft), and reinserted into the disc cavity 21 to change a right-handed putter into a left-handed putter.

The putter head blade 13 in a preferred embodiment has an overall length dimension from 5 inches to 7 inches long from the toe end 81 to heal end 82. The base weight cylinders 14 in a preferred embodiment are from one inches to two inches in diameter, based on the need to blend with the overall size and shape of the putter head blade 13. The overall depth of the putter from the putter face 36 to the back of the base weight cylinder or the additional weight cylinder may be in the range of 1.125 inches to 4.00 inches, although this dimension is not limiting on the inventive aspects.

The assembled putter head 10 in a preferred embodiment has a total weight of from 300 grams to 650 grams depending on the combination of base weight cylinders and additional weight cylinders utilized.

With particular reference now to FIG. 2, and FIGS. 23 to 29, the threaded weight cylinder attachment stud 42 has male threads which are threaded into the female threads in the female thread connecting stud hole 31. The stud 42 is tightened into a fixed position in the putter head blade 13. The stud 42 may be optionally further secured by means of epoxy or other liquid applied gluing agent.

A high moment of inertia is obtained in the present inventive device through an extreme configuration of weights added to the head blade 13. Base weight cylinders 14 and additional weight cylinders 15 are secured to the head blade 13 at the extreme toe and heel ends 81, 82 of the head blade 13 to maximize their distance from the blade center and the intended point of contact in use. To maximize mass at these locations, the weight cylinders 14, 15 extend orthogonally outward from the back of the blade 13. This enables a high inertia while maintaining a useful total weight for a putter head.

the base weight cylinder 14 has female threads which are threaded into the male threads of the attachment stud 42. The base weight cylinder 14 is tightened into a fixed position on the attachment stud 42 against the back of the putter head blade 13. The base weight cylinder 14 may be optionally further secured by means of epoxy or other liquid applied gluing agent. The additional weight cylinders 15 are attached to the base weight cylinder 14 by means of the weight cylinder attachment screw 52 (FIG. 1). The weight cylinder attachment screw 52 has male threads which are threaded into the female threads of the base weight cylinder 14. The weight cylinder attachment screws are tightened into a fixed condition into the base weight cylinder 14. The weight cylinder attachment screws 52 may be optionally further secured by means of epoxy or other liquid applied gluing agent.

Alternative shapes and sizes of the weight cylinders 14, 15 are contemplated and may be used with similar effect and function. The cylindrical shape is advantageous for multiple reasons including maximizing the mass at the extreme extent of the blade 13 while providing a smooth outline. Similarly, the method and mechanism of securing the cylinders 14, 15 to the blade 13 may be altered or replaced by others providing the same function.

Figure 10:
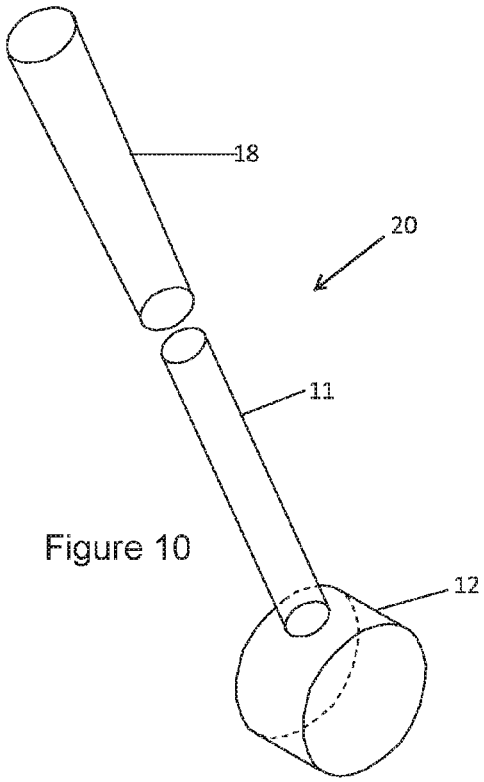
FIGS. 10 to 13 illustrate components for securing a putter handle to the putter head according to the configuration of FIG. 1.
Figure 11:
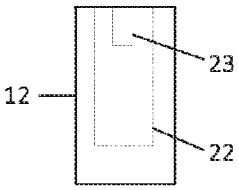
Figure 12:
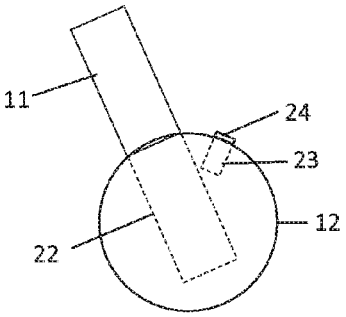
Figure 13:
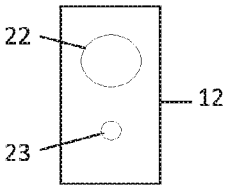

With reference to FIG. 10 the shaft 11 is secured in the shaft receiver disc 12 by means of epoxy or other permanent fixing means; and the grip is secured to the shaft by means of double-sided tape (the grip 18 is shown separated for clarity of illustration). The rotation stop pin 24 is secured in the shaft receiver disc 12 by means of epoxy or other permanent fixing means. This combination of shaft 11 and receiver disc 12 may be alternatively provided by an integral construction or other construction combinations resulting in the same end result.

With particular reference to FIGS. 1, 16 and 21 the alignment pin 17 is attached to the disc compression cover 16. The male threaded alignment pin stud 74 is threaded into the female threads in the alignment pin hole 73. The alignment pin 17 tightened into a normally not rotating position into the disc compression cover 16. The alignment pin 17 may be secured by means of epoxy or other liquid applied adhesive agent. Other configurations of alignment pin 17 and securing the same to the putter head are contemplated and variations may be used without deviating from the benefits and intentions of the invention.

With particular reference to FIGS. 1, 2, 14 and 15 the shaft receiver disc 12 with the shaft and rotation stop pin 24 attached is slid into the disc cavity 21 with the shaft 11 and rotation stop pin 24 sliding into the opening between the opposing rotation stop seats 33. In this configuration, the shaft receiver disc 12 can initially freely rotate in the disc cavity 21 between the limits of the rotation stop seats 33. Other constructions providing the same rotational movement between the shaft 11 and blade 13 and providing the same operational functions may be used with equal effect.

Figure 40:
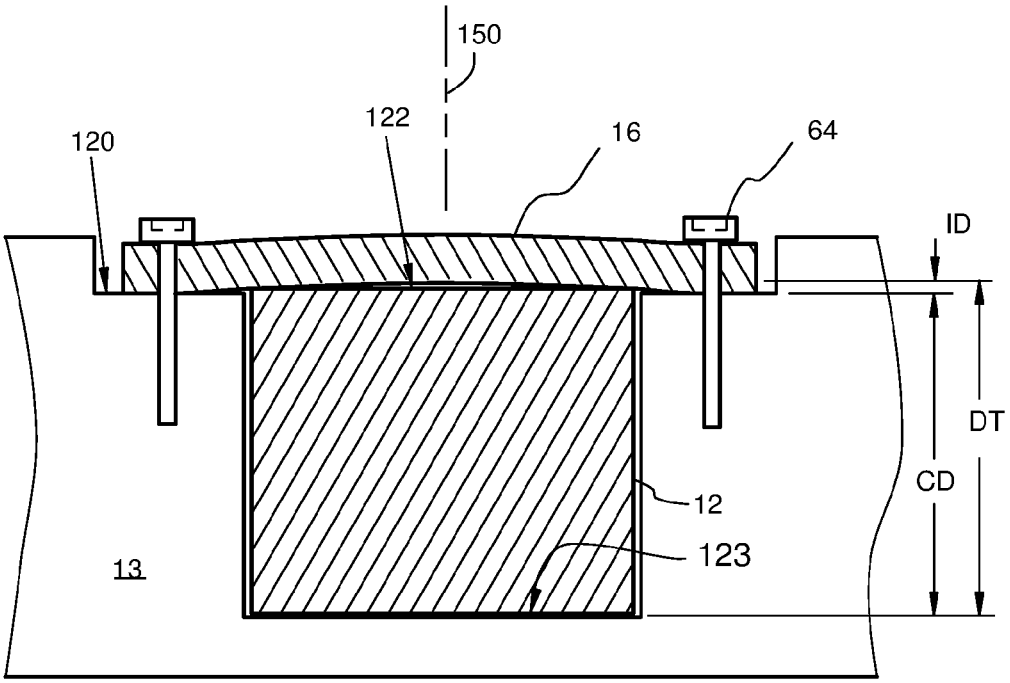
FIGS. 40 and 41 illustrate details of the shaft receiver disc and the disc compression cover in one embodiment.
Figure 41:
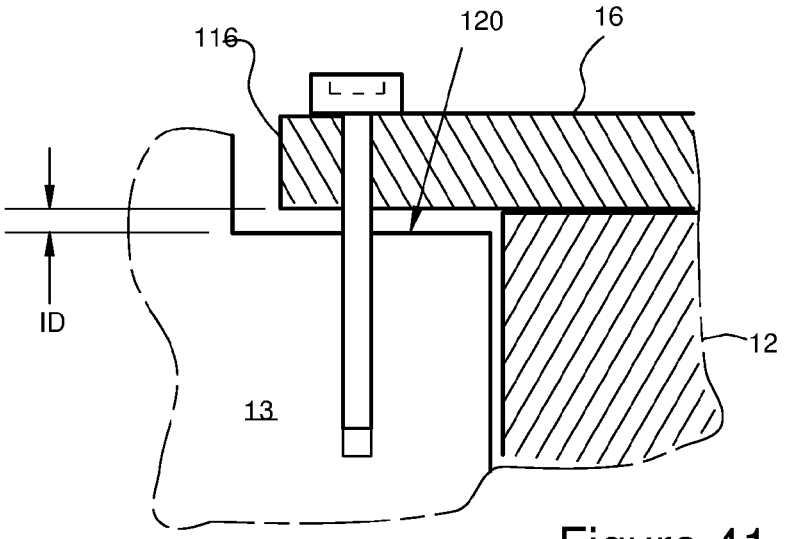

The shaft receiver disc 12 is retained in the disc cavity 21 by the disc compression cover 16. The disc compression cover 16 is secured into place in the disc compression cover seat 61 by means of four disc compression cover attachment screws 64. The shaft receiver disc 12 is at least 0.003" thicker that the depth of the disc cavity 21. This difference in dimensions causes the disc compression cover 16 to bind the circumferential edge of the shaft receiver disc 12. The disc compression cover 16 is thin enough to bend by the force of the four disc compression cover attachment screws 64 applied at four corners of the disc compression cover 16. This warping of the disc compression cover 16 reduces the frictional pressure on the rear surface of the shaft receiver disc 12 while at the same time increasing the frictional binding pressure at the circumferential edge of the shaft receiver disc 12. The shaft receiver disc 12 is pinched in place at its edge rather than being restrained from rotation by simple surface friction. This is illustrated in FIG. 40, an enlarged section view of a portion of the putter head blade including the receiver disk 12 in the disk cavity 21 and the compression cover 16. The disk 12 may rotate about its axis 150 during adjustment. In the figure it can be seen that the axial dimension (thickness) DT of the disc 21 is slightly greater than the disc cavity depth CD. The cavity depth CD extends axially from the bottom 123 of the disc cavity 21 to the seating surface 120. The seating surface 120 is formed on the head blade 13 and is configured to receive the compression cover 16. The receiver disk 12 extends axially outside the cavity 21 such that the outer face 122 of the receiver disc 12 is outside the plane of the seating surface 120. The difference between the axial dimension DT and the cavity depth CD is the interference dimension ID. The interference dimension ID must be greater than zero and large enough that when the compression cover 16 is in contact with the outer face 122 and unsecured there is a gap between portions 116 of the compression cover 16 that extend beyond the disk 12 and the seating surface 120. When the attachment screws 64 are then fully engaged, the compression cover portions 116 are deformed to allow them to reach and contact the seating surface 120, thereby establishing a rigid connection. The deformation (warping) of the compression cover 16 results in increased compression force at the perimeter of the outer face 122. This deformation is illustrated in the figure wherein the compression cover 16 is "bowed" up at the center in reaction while the compression cover 16 is bent downward over the perimeter of the disk 12. This "pinching" action provides a needed rigidity not otherwise obtainable. The interference dimension ID must not be too large, otherwise it will not be possible to fully engage the compression cover 16 with the seating surface 120, resulting in a unstable condition. The interference dimension ID must be no more than a small fraction of the thickness of the compression cover 16 so that the compression cover 16 is not plastically deformed when fully secured. The interference dimension should at least 0.0030 inches and no greater than 0.0070 inches for these reasons. FIG. 41 is a further enlargement of the compression cover 16 and disk 12 at the perimeter where the described pinching occurs. In this figure, the compression cover 16 is in contact with the disk 12 prior to deformation to enable contact with the cover seat surface 120. The gap between the compression cover 16 and cover seat surface 120 is not to scale but emphasized for clarity.

A function of the compression cover 16 is to provide a device and means of providing adjustable frictional constraint to relative rotation of the disc 12 within the cavity 21. This enables user adjustment of the lie angle as described in the following.

During an adjustment of the lie angle of the putter, the disc compression cover attachment screws 64 are partially loosened to allow rotation of the shaft receiver disc 12 in the shaft disc cavity 21. This allows controlled rotation of the disc 12 while maintaining its location within the cavity 21. When the desired lie angle is determined and established, the disc compression cover attachment screws can be tightened which eliminates rotation. Once the disc compression cover 16 is secured, set screws 35 located in the bottom of the putter blade 13 can be tightened. With both the set screws 35 and disc compression cover attachment screws 64 fully tightened the shaft receiver disc can no longer rotate at all and the lie angle is locked.

Together, the disc compression cover 16 and the screws 35 provide attachment means that provide adjustable and also rigid securing of the shaft 11 to the blade 13. Other devices and mechanisms that provide the same or equal function and result are contemplated and further devices and mechanism may become obvious to those skilled in the art or be developed in the further.

Accordingly, the invention includes putter embodiments having:

A golf putter head having:

a putter blade with a striking face, a cylindrical disc cavity behind the striking face, a cylindrical shaft receiving disc which can be inserted into the disc cavity, and capable of rotation in the disc cavity for lie angle adjustment, said shaft receiving disc having a shaft bore hole and a putter shaft installed in the said shaft bore hole, said shaft receiving disc having a rotation stop bore hole and the rotation stop pin installed in the rotation stop bore hole, said rotation stop limiting the rotation of the shaft receiving disc, said disc cavity being open to the top of the putter blade, and said opening in the putter blade formed by opposing rotation stop seats that obstruct the rotation of the shaft on the proximal side of the hole into the disc cavity and obstructs the rotation of the rotation stop pin on the distal side of the hole into the disc cavity, said rotation stop seats together limiting the lie angle to from 10 degrees from vertical to 26 degrees from vertical, said disc cavity also being open to the rear of the putter blade, with the rear opening of the disc cavity covered by a disc compression cover incised into the back of the putter blade, said disc compression cover being attached to the putter head by means of four screws, limiting the rotation of the shaft receiving disc, said disc cavity also having two holes through the bottom of the disc cavity and through the bottom of the putter blade for the insertion of two set screws, said set screws being the primary means for securing the shaft receiving disc in the required rotation for a desired lie angle, said putter blade having a holes bored in the back of the putter blade for the attachment of cylindrical weights onto the proximal (heel) and distal (toe) ends of the putter blade back, said cylindrical weights having a hole bored through the weight center for the insertion of a threaded stud, with the said threaded stud being inserted also into the hole in the back of the putter blade, said cylindrical weight alternatively having a non-threaded through which a screw is inserted into the hole in the back of the putter blade, said putter head being flat on the bottom with all elements on a single plane, putter head has an indicium on top of the putter head 1.68 inches wide.

Figure 30:
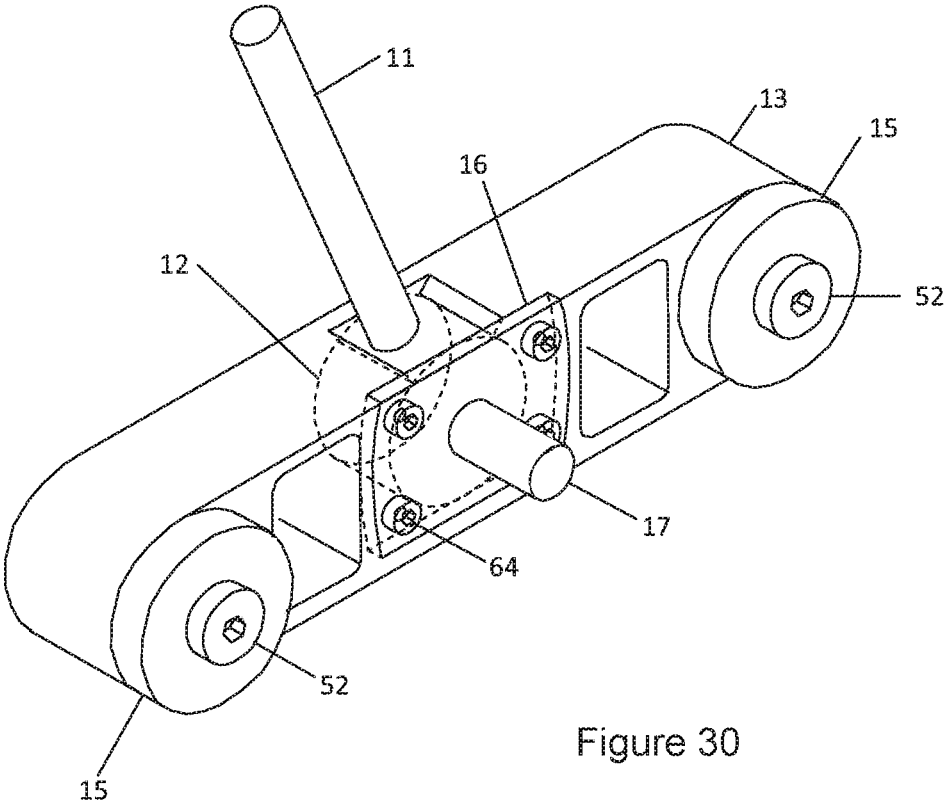
FIG. 30 is an isometric view of an alternative embodiment of the putter head.

FIG. 30 illustrates an alternative configuration of the putter in which base weights are not included but rather the additional weight cylinders 15 are secured directly to the putter head blade 13. This configuration is otherwise equal to that described above but may be applied were less added weight is needed, or otherwise a single set of weights is sufficient.

Figure 31:
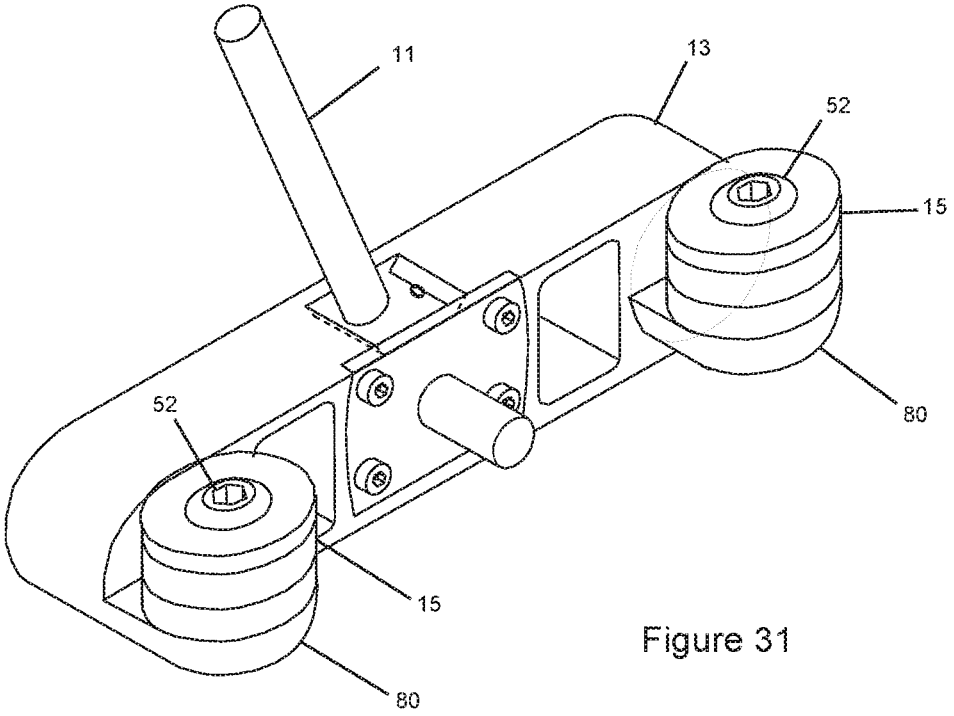
FIG. 31 is an isometric view of a further alternative embodiment of the inventive putter.
Figure 32:
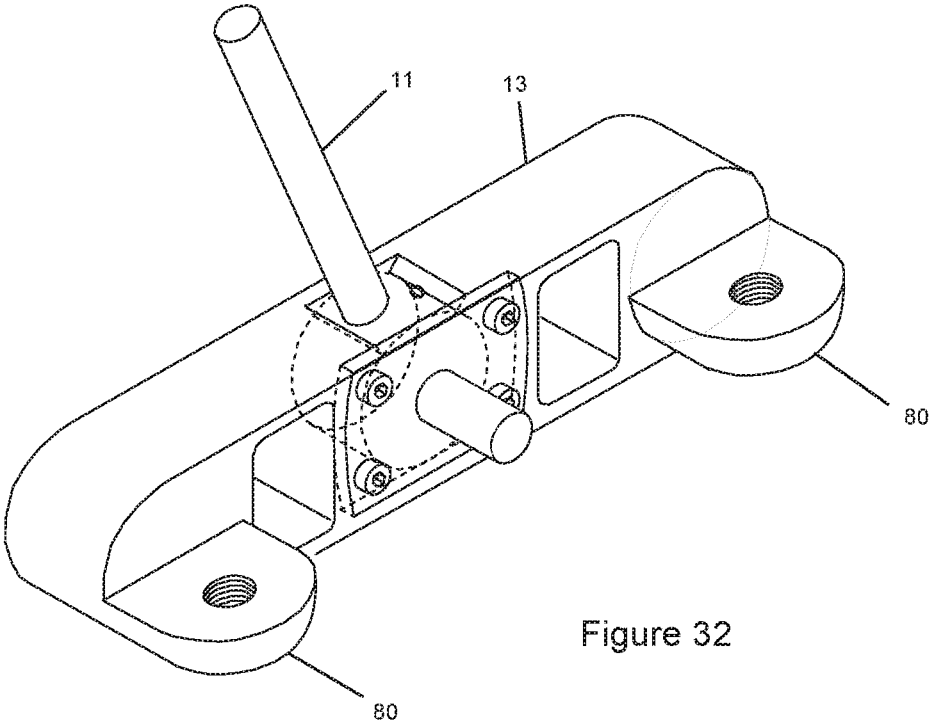
FIG. 32 is an isometric view of the putter head of FIG. 31 after removable weights have been removed.
Figure 34:
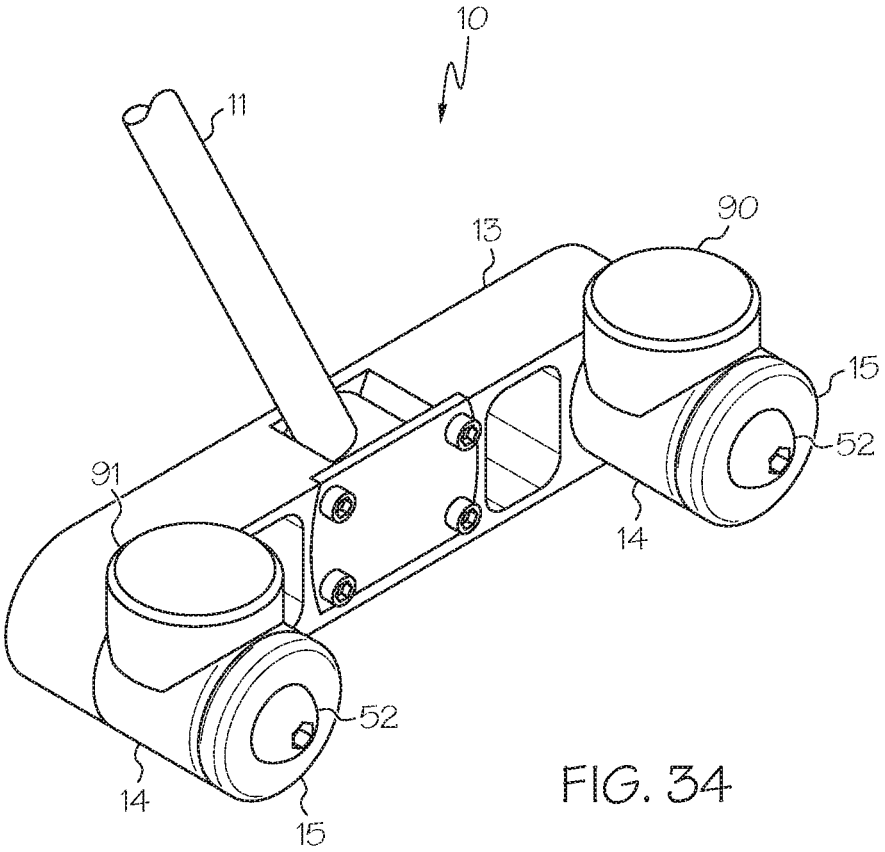
FIG. 34 is an isometric view of a further alternative configuration of the inventive putter.
Figure 35:
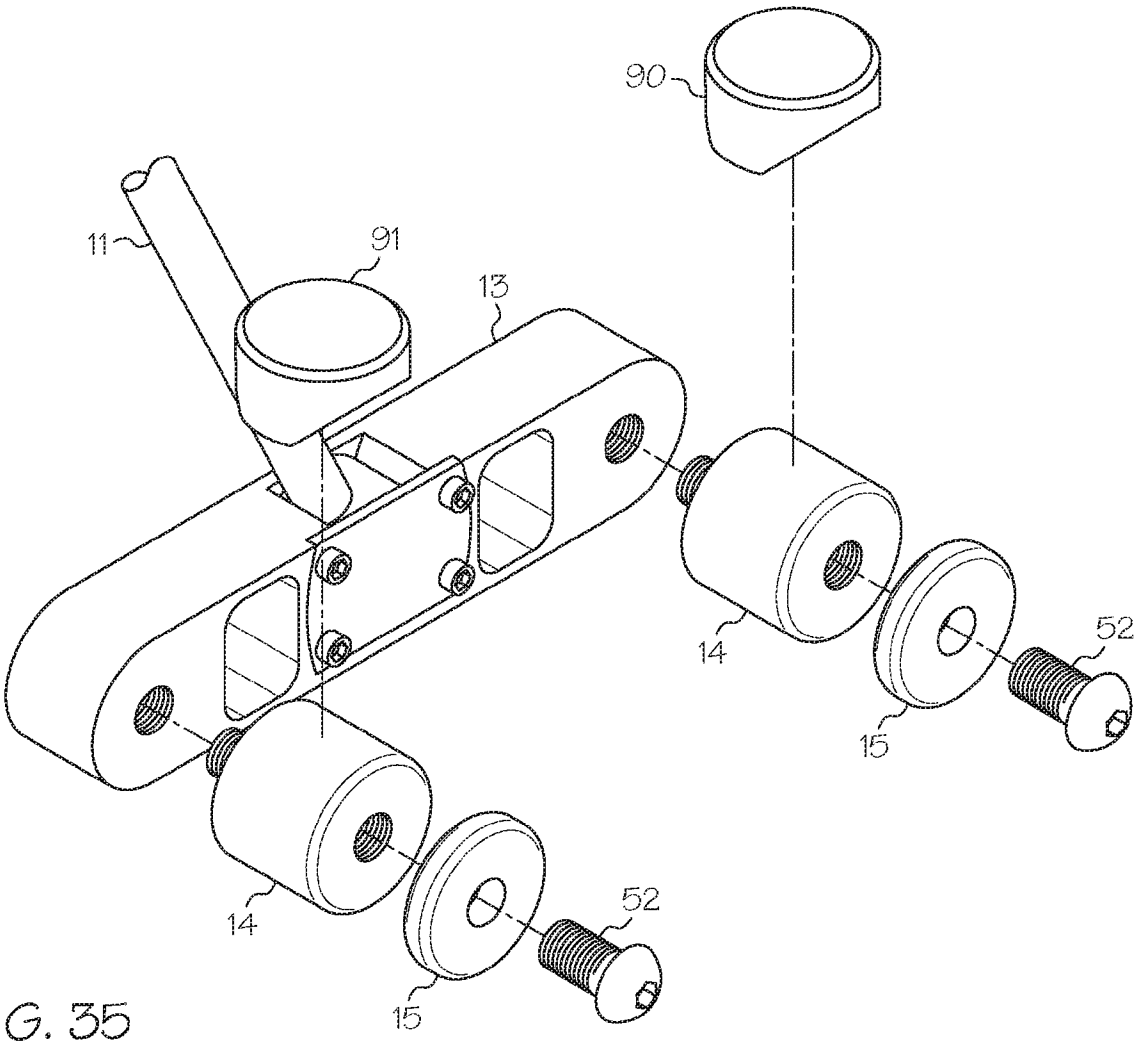
FIGS. 35 to 37 are exploded isometric and side views, respectively, of the configuration of FIG. 34.
Figure 36:
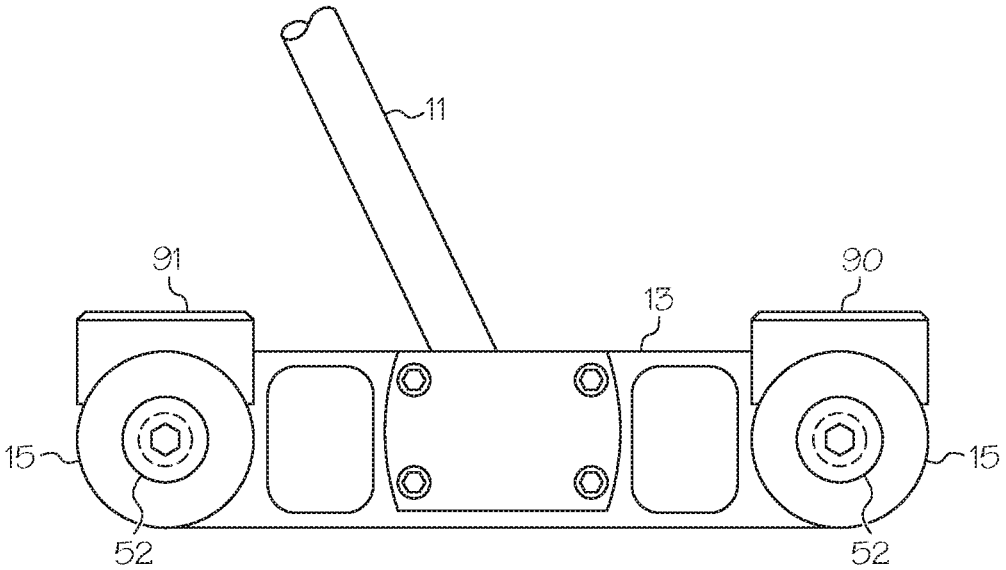
Figure 37:
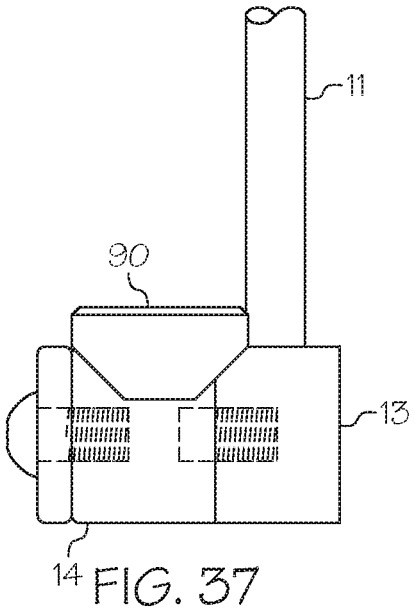

FIGS. 31 to 33D depict a further alternative configuration of the inventive putter. In this configuration similar weights are provided at the extreme ends 81, 82 of the head blade 13 to maximize their distance from the blade center and the intended point of contact in use. To maximize mass at these locations, weight cylinders 15 extend upward in a vertical stack from a weight support arm 80. The support arm 80 extends outward horizontally from the back of the blade 13 and includes a mechanism to secure the weight cylinders 15. In the configuration shown, an attachment screw 52 is used to secure the cylinders 15 to the support arm 80, in the same manner as described above. The support arm 80 is preferably formed integral with the blade 13. It should be understood that the orientation of the weight cylinders 15 in the various configurations of the invention is not critical if their relative center of mass location is the same. In this way, the configuration of FIG. 31 is equivalent to that of FIG. 1.

FIGS. 34 to 37 depict a further alternative configuration of the inventive putter and putter head 10. This configuration incorporates the same putter blade 13 and base weight cylinders 14 as the configuration depicted in FIGS. 1 to 29. The base weight cylinders 14 are formed separate but preferably permanently secured to extend backward (in a direction opposite to the outward normal of the putter face 36) in the same location as discussed previously. They may be secured via threaded fasteners and permanent bonding adhesive or an equivalent that provides rigid joining. A set of additional weight cylinders 15 may be removably secured by center threaded fasteners such as the attachment screw 52. Other devices and mechanisms to provide an equivalent securing are also contemplated.

Two alignment indicia 90, 91 are used to provide visual alignment cues to a user. Each is secured to the top of one of the base weight cylinders 14 in a common manner and particular location relative to the head face 36. The two alignment indicia 90, 91 are configured, located and secured such that during appropriate placement of the putter in use, the alignment indicia 90, 91 have a common vertical visual projection. This visual projection should be visually contrasting with respect to all other elements of the putter head 10. This may be accomplished by using contrasting colors, preferably with the alignment indicia 90, 91 having either a white or light metallic color and the other elements having darker surface color. The alignment indicia 90, 91 should be located a common distance rearward from the plane of the head face 36 and symmetrically distanced on the two sides (toe-ward and heel-ward) of the intended strike point on the head face 36. The vertical projection of the alignment indicia 90, 91 is preferably circular and approximately with a diameter equal that of a regulation golf ball—typically about 1.7 inches, although somewhat smaller and larger diameters will function similarly. The vertical projection may be formed of a circular horizontal planar surface of the alignment indicia as shown in the figures, or other surface shapes appearing circular in vertical projection.

Using the alignment indicia 90, 91 as described, a user looking downward onto the inventive putter head 10, that is aligned with a golf ball in preparation of striking it, is induced to see and coordinate in their mind the location of the 90, 91 with the golf ball. Due to the symmetric location of the alignment indicia 90, 91 and their clearly discerned location, the user will naturally align the putter head 10 in the desired orientation: with the putter face 36 perpendicular to the desired golf ball travel path.

Each alignment indicia 90, 91 preferably has a concave cylindrical backside face to mate with the curved perimeter sides of the base weight cylinders as shown. Preferably, the each alignment indicia 90, 91 would be weightless to eliminate influence on the mass properties of the head 10. Toward this goal, the alignment indicia 90, 91 should be formed of very light weight material that is also resistant to weathering. Low density metals such as aluminum or plastics may be used. Each balancing saddle weight is preferably secured permanently to a respective base weight cylinder 14 using permanent adhesive or equivalent material, device or mechanism.

Figure 38:
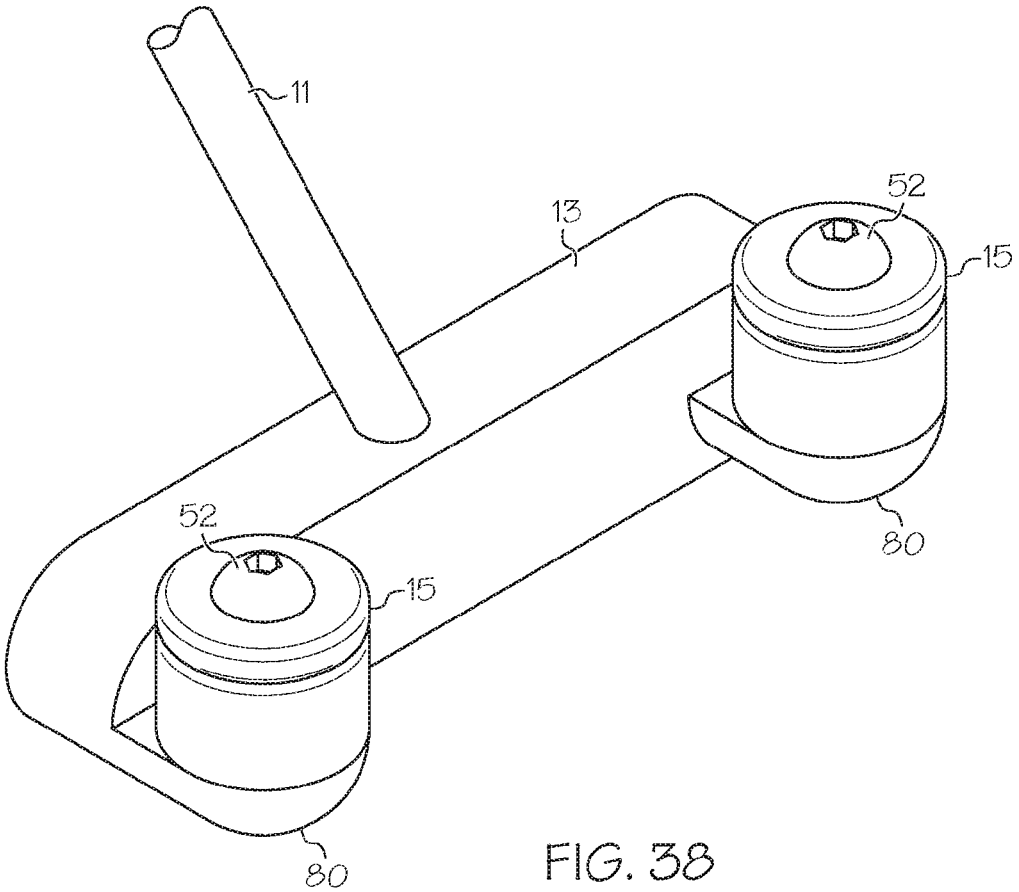
FIG. 38 is an isometric view of an alternative configuration of the inventive putter with a fixed shaft.

FIG. 38 illustrates an alternative configuration of a putter according to the invention. The putter head includes a head blade 13 that is rigidly secured to or integral with the shaft 11. The previously described structures and elements providing for relative angular adjustment of the shaft 11, such as the shaft receiving disk and compression cover (12, 16 FIGS. 1, 31) are not included. The weight balancing elements and operations described respecting the prior configurations are functional and beneficial in a putter not having shaft adjustment. In this exemplary configuration, the same weight support arm 80 and cylinders 15 are included and function in the manner described above.

Figure 39A:
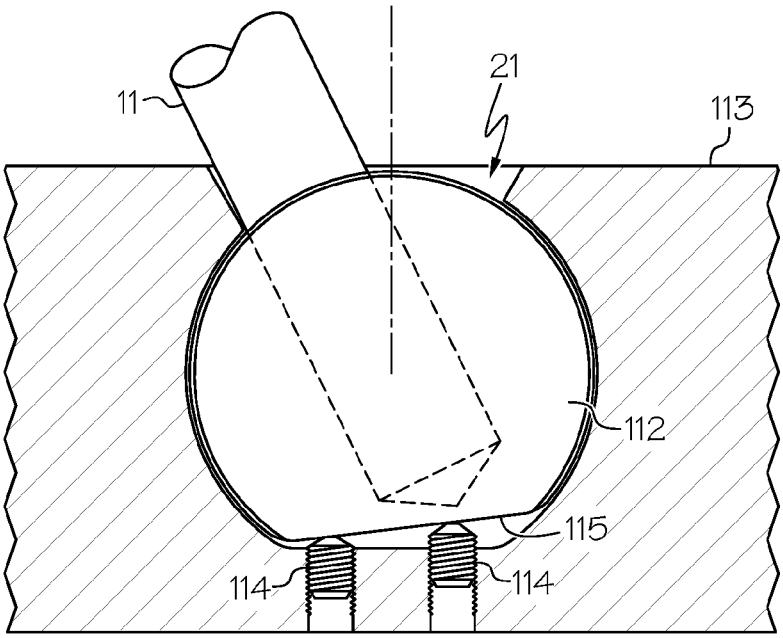
FIGS. 39A and 39B illustrate an alternative configurations of components of the inventive putter.
Figure 39B:
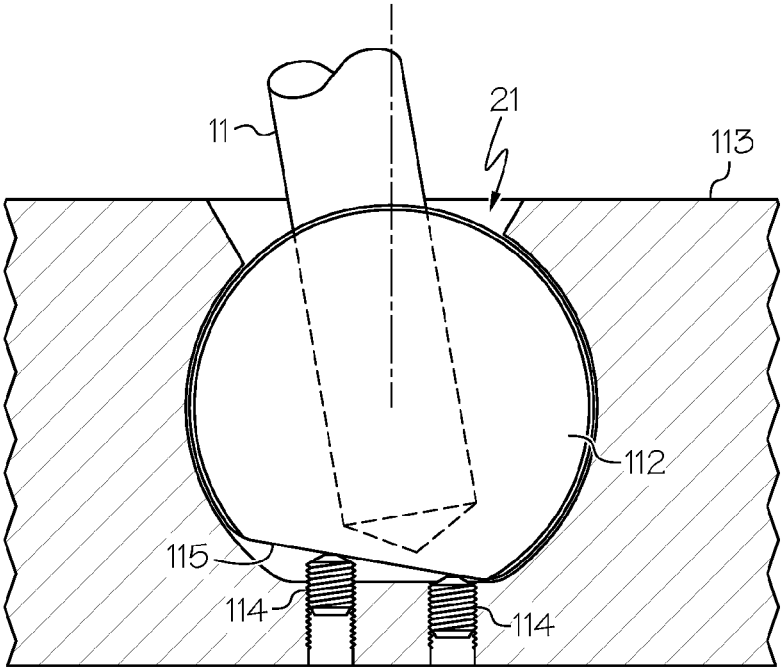

FIGS. 39A and 39B illustrate an alternative configuration of the shaft receiver disc 12 discussed above. The two figures illustrate two exemplary alternative angular orientations of an alternative disc 112 within a putter head 10. The figures provide a detailed partial section view of the putter head 10. The essential form and function of this alternate disc 112 is the same, but it includes distinct features for controlling the relative angular orientation of the alternative disc 112 together with the attached shaft 11. First, the alternate disc 112 includes a control surface 115 as a flat surface formed through a chord line across the circular cross-section of the disc body. The plane of the control surface 115 is preferably about 70 degrees from the centerline of the shaft 11 (and from the shaft-receiving hole in the disc). This angle establishes the relative angle of the shaft 11 to the head 10 when fully assembled as intended. The alternative disc 112 is received in the disc cavity 21 in the same manner as described above. The cavity 21 includes a flat bottom portion that, in cooperation with the control surface 115, defines limits to the range of rotation of the alternative disc 112. This angular control is fixed by the geometry of the respective elements.

A second feature for controlling the angular orientation of the disc 112 are two rigid stops in the form of set screws 114 that each extend from the body of the head 10 and into the disc cavity 21 towards the control surface 115. The function of the set screws 114 is to provide a positive interference with the control surface 115 to prevent rotation of the alternative disc 112 when in an adjusted fixed condition. The particulars of the position and length of the set screw 114 may vary and depend on the specific geometry of the control surface 115. In use, the alternative disc 112 is located in the desired rotational position, aided by the cooperating control surface 115 and set screws 114, and then secured for use in the same manner as detailed previously. Because each set screw 114 is adjustable, the angular orientation of the alternative disc 112 may be set or limited at a variety of different positions.

Other configurations and devices for accomplishing the same or equivalent inventive functions and results as described in the above examples are contemplated and will be discernable from the above discussion and the teachings herein.

The invention claimed is:

1. A golf putter comprising:

a putter head, the head having a cavity and a seat surface surrounding the cavity;

a disk disposed in the cavity and having an outer face, the disk extending from the cavity an interference dimension beyond the seat surface to the outer face;

the disk configured to rotate within the cavity about an axis in an adjustment condition;

a plate located in contact with the outer face with a portion of the plate extending beyond the outer face and parallel the seat surface;

the portion biased toward and contacting the seat surface in a fixed condition;

an elongated shaft fixed to the disk; and at least one set of balance weights, each set comprising at least two balance weights;

the head configured to receive and removably retain each set of balance weights.

2. A golf putter, according to claim 1, and further comprising:

multiple threaded fasteners securing the plate to the seat surface.

3. A golf putter, according to claim 2, and wherein:

the head has a toe end and a heel end and includes a first and second weight support, the first weight support extending rearward from the toe end of the head and the second weight support extending rearward from the heel end of the head; wherein:

each weight support is configured to receive and removably retain at least one balance weight.

4. A golf putter, according to claim 2, and wherein:

each weight support comprises a respective threaded fastener.

5. A golf putter, according to claim 1, and wherein:

the interference dimension is in the range of 0.003 and 0.007 inch.

6. A golf putter, according to claim 1 and wherein the disk includes a flat control surface;

and further comprising:

a set screw extending from the head and into the cavity and contacting the control surface in the fixed condition to resist rotation of the disk.

* * * * *